US006318834B1

(12) United States Patent
Otsuka et al.

(10) Patent No.: US 6,318,834 B1
(45) Date of Patent: Nov. 20, 2001

(54) INK JET RECORDING APPARATUS AND METHOD OF CONTROLLING THE SAME BASED ON CARTRIDGE ABSENCE TIME PERIOD

(75) Inventors: Nobutoshi Otsuka; Zenta Kosaka, both of Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/422,628

(22) Filed: Oct. 21, 1999

(30) Foreign Application Priority Data

Oct. 29, 1998 (JP) ..... 10-309038

(51) Int. Cl.[7] ..... B41J 2/165
(52) U.S. Cl. ..... 347/23
(58) Field of Search ..... 347/23, 30

(56) References Cited

FOREIGN PATENT DOCUMENTS 8-174863A * 7/1996 (JP) ..... B41J/2/175

* cited by examiner

*Primary Examiner*—David F. Yockey
(74) *Attorney, Agent, or Firm*—Hogan & Hartson, L.L.P.

(57) ABSTRACT

In an ink jet recording apparatus and method recording is performed by using a replaceable ink cartridge mounted in the ink jet recording apparatus, and includes a recording head for delivering ink therefrom. Cleaning of the recording head is carried out by sucking ink from the recording head. A cartridge absence time period is detected over which continues a cartridge-unmounted state of the ink jet recording apparatus in which the ink cartridge is removed from the ink jet recording apparatus. An amount of ink to be sucked for the cleaning is set, based on the cartridge absence time period, when the ink cartridge is mounted in the ink jet recording apparatus.

6 Claims, 6 Drawing Sheets

| CARTRIDGE ABSENCE TIME PERIOD (hour) | INK SUCTION AMOUNT (g) |
|---|---|
| $0 \leqq t < 6$ | 0.3 |
| $6 < t \leqq 24$ | 0.5 |
| $24 < t \leqq 48$ | 1.0 |
| $48 < t \leqq 168$ | 2.0 |
| $168 < t$ | 3.0 |

FIG. 6

| CARTRIDGE ABSENCE TIME PERIOD (hour) | INK SUCTION AMOUNT (g) |
|---|---|
| $0 \leqq t < 6$ | 0.3 |
| $6 < t \leqq 24$ | 0.5 |
| $24 < t \leqq 48$ | 1.0 |
| $48 < t \leqq 168$ | 2.0 |
| $168 < t$ | 3.0 |

INK JET RECORDING APPARATUS AND METHOD OF CONTROLLING THE SAME BASED ON CARTRIDGE ABSENCE TIME PERIOD

BACKGROUND OF THE INVENTION

1. Field of the Invention

This invention relates to an ink jet recording apparatus and a method of controlling the same, and more particularly to a cleaning technique for carrying out cleaning after replacement of ink cartridges and a warning technique for issuing a warning when the ink jet recording apparatus is left without an ink cartridge.

2. Prior Art

Conventionally, there has been proposed an ink jet recording apparatus which is capable of carrying out cleaning operation automatically after replacement of ink cartridges for delivering ink therefrom, so as to ensure reliable printing operations and positively fill a recording head with ink.

The cleaning operation is an operation of drawing ink by suction from an ink reservoir within an ink cartridge mounted in the ink jet recording apparatus into a cap arranged in a non-printing area of a printing mechanism of the ink jet recording apparatus via nozzles of the recording head, so as to prevent the nozzles from being clogged and remove air bubbles from ink passages.

In the cleaning operation, the recording head is hermetically capped, and then a pump creates negative pressure in a gap formed between the recording head and the cap. As a result, ink is drawn from the recording head into the cap, whereby the recording head is cleaned.

The conventional ink jet recording apparatus has no problem in cleaning when a new ink cartridge is mounted therein immediately after removal of an old one. However, if the apparatus is left without an ink cartridge for a long time, ink remaining within the recording head (i.e. within the ink passage and the nozzle) dries and solidifies.

As a result, a cleaning operation performed when an ink cartridge is mounted in the apparatus after a long interval requires an increased amount of ink to be sucked from the ink cartridge through execution of an increased number of times of cleaning, which shortens the service life of the ink cartridge. Further, the amount of waste ink which is not used for actual printing is increased, which results in an increase in running costs.

SUMMARY OF THE INVENTION

It is a first object of the invention to provide an ink jet recording apparatus and a method of controlling the same which make it possible to save a user's time and labor required for cleaning when the apparatus has an ink cartridge mounted therein after being left without an ink cartridge for a long time period.

It is a second object of the invention to provide an ink jet recording apparatus and a method of controlling the same which are capable of issuing a warning to a user when the apparatus has been left without an ink cartridge for a long time period and reducing the amount of ink to be sucked for cleaning when an ink cartridge is mounted in the apparatus.

To attain the first object, according to a first aspect of the invention, there is provided an ink jet recording apparatus for recording by using a replaceable ink cartridge mounted therein, comprising:

a recording head for delivering ink therefrom;

cleaning means for carrying out cleaning of the recording head by sucking ink therefrom;

cartridge absence time-detecting means for detecting a cartridge absence time period over which continues a cartridge-unmounted state of the ink jet recording apparatus in which the ink cartridge is removed from the ink jet recording apparatus; and suction amount-setting means for setting an amount of ink to be sucked for the cleaning, based on the cartridge absence time period, when the ink cartridge is mounted in the ink jet recording apparatus.

Preferably, the ink jet recording apparatus further comprises cartridge-unmounted state-detecting means for detecting the cartridge-unmounted state of the ink jet recording apparatus.

More preferably, the cartridge absence time-detecting means includes timer means for counting duration of the cartridge-unmounted state of the ink jet recording apparatus detected by the cartridge-unmounted state-detecting means.

Preferably, the suction amount-setting means includes storage means for storing predetermined values of the amount of ink to be sucked corresponding respectively to predetermined time periods to be detected as the cartridge absence time period.

To attain the first object, according to a second aspect of the invention, there is provided a method of controlling an ink jet recording apparatus for recording by using a replaceable ink cartridge mounted therein, the ink jet recording apparatus having a recording head connected to the ink cartridge for delivering ink supplied from the ink cartridge, the method comprising the steps of:

detecting a cartridge absence time period over which continues a cartridge-unmounted state of the ink jet recording apparatus in which the ink cartridge is removed from the ink jet recording apparatus; and setting an amount of ink to be sucked for cleaning of the recording head, based on the cartridge absence time period, when the ink cartridge is mounted in the ink jet recording apparatus; and carrying out the cleaning of the recording head by sucking ink therefrom.

Preferably, the step of detecting the cartridge absence time period includes the step of detecting whether or not the cartridge is mounted in the ink jet recording apparatus.

To attain the second object, according to a third aspect of the invention, there is provided an ink jet recording apparatus for recording by using a replaceable ink cartridge mounted therein, comprising:

cartridge absence time-detecting means for detecting a cartridge absence time period over which continues a cartridge-unmounted state of the ink jet recording apparatus in which the ink cartridge is removed from the ink jet recording apparatus; and warning means for issuing a warning to a user so as to prompt the user to mount the ink cartridge in the ink jet recording apparatus each time that the cartridge absence time period reaches at least one predetermined time period.

Preferably, the ink jet recording apparatus further comprises cartridge-unmounted state-detecting means for detecting the cartridge-unmounted state of the ink jet recording apparatus.

More preferably, the cartridge absence time-detecting means includes timer means for counting duration of the cartridge-unmounted state of the ink jet recording apparatus detected by the cartridge-unmounted state-detecting means.

Preferably, the warning means includes a liquid crystal display device for displaying thereon a message for the warning.

Alternatively, the warning means includes a buzzer device for making a buzzing sound for the warning.

Alternatively, the warning means includes an LED display device having at least one LED for being flashed for the warning.

To attain the second object, according to a fourth aspect of the invention, there is provided a method of controlling an ink jet recording apparatus for recording by using a replaceable ink cartridge mounted therein, the method comprising the steps of:

detecting a cartridge absence time period over which continues a cartridge-unmounted state of the ink jet recording apparatus in which the ink cartridge is removed from the ink jet recording apparatus; and issuing a warning to a user so as to prompt the user to mount the ink cartridge in the ink jet recording apparatus each time that the cartridge absence time period reaches at least one predetermined time period.

Preferably, the step of detecting the cartridge absence time period includes the step of detecting whether or not the cartridge is mounted in the ink jet recording apparatus.

In the second and fourth aspects of the invention, more preferably, the ink jet recording apparatus includes timer means, and the step of detecting the cartridge absence time period includes the steps of starting the timer means for counting duration of the cartridge-unmounted state of the ink jet recording apparatus when it is detected that the ink cartridge is not mounted in the ink jet recording apparatus, and the step of stopping the timer means for terminating the counting of the cartridge-unmounted state of the ink jet recording apparatus when it is detected that the ink cartridge is mounted in the ink jet recording apparatus.

The above and other objects, features, and advantages of the invention will become apparent from the following detailed description taken in conjunction with the accompanying drawings.

BRIEF DESCRIPTION OF THE DRAWINGS

FIG. 6 is a table which is useful in explaining the relationship between a cartridge absence time period and an amount of ink to be sucked.

DETAILED DESCRIPTION

The invention will now be described in detail with reference to the drawings showing an embodiment thereof.

Figure 1:
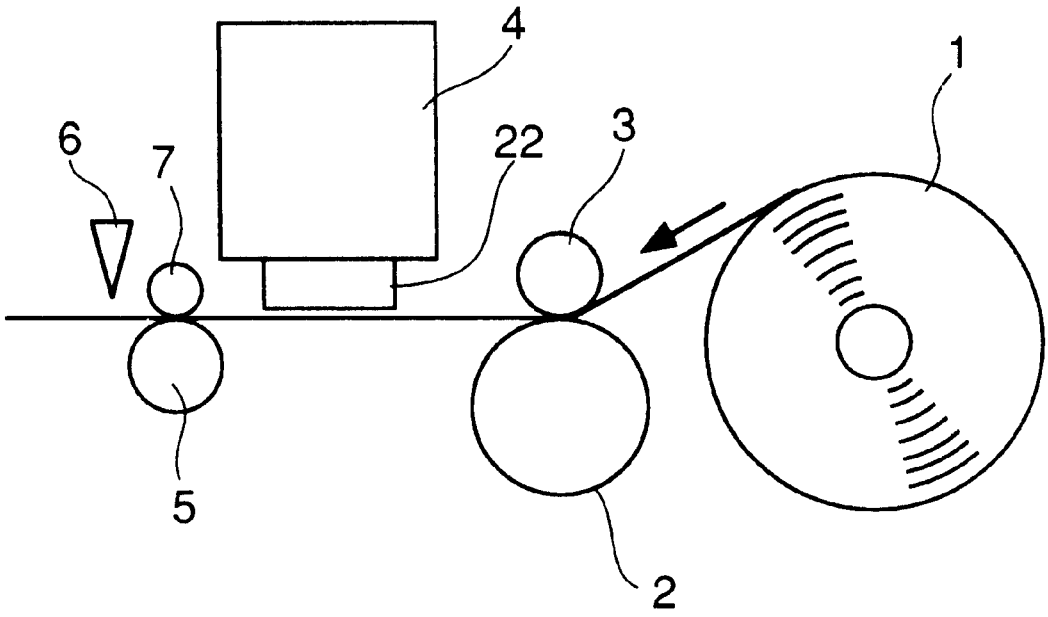
FIG. 1 is a view schematically showing the arrangement of essential component of an ink jet recording apparatus according to an embodiment of the invention.

FIG. 1 schematically shows the arrangement of essential components of an ink jet recording apparatus according to the embodiment.

The ink jet printing apparatus (label printer) 100 is comprised of a tape (recording medium in the form of a tape) 1 wound into a roll and fed as a print material, a feed roller 2 for feeding the tape 1, a tape-retaining roller 3 arranged at a location opposed to the feed roller 2, for retaining the tape 1 during feeding of the same, a carriage 4 for carrying a recording head 22, referred to hereinafter, in a direction orthogonal to a direction of feeding the tape 1, a support/feed roller 5 for supporting the tape 1 by a predetermined tensile force during printing by the recording head 22 and for feeding the tape 1, a cutter 6 for cutting off a printed portion of the tape 1, and a tape-retaining roller 7 arranged at a location opposed to the support/feed roller 5, for retaining the tape 1 during feeding of the same.

The tape 1 used in the present embodiment is e.g. one having an underside surface coated with an adhesive layer and covered by a release paper. However, this is not limitative, but a simple tape-like sheet having no adhesive layer or release paper may be used as the recording medium.

Figure 2:
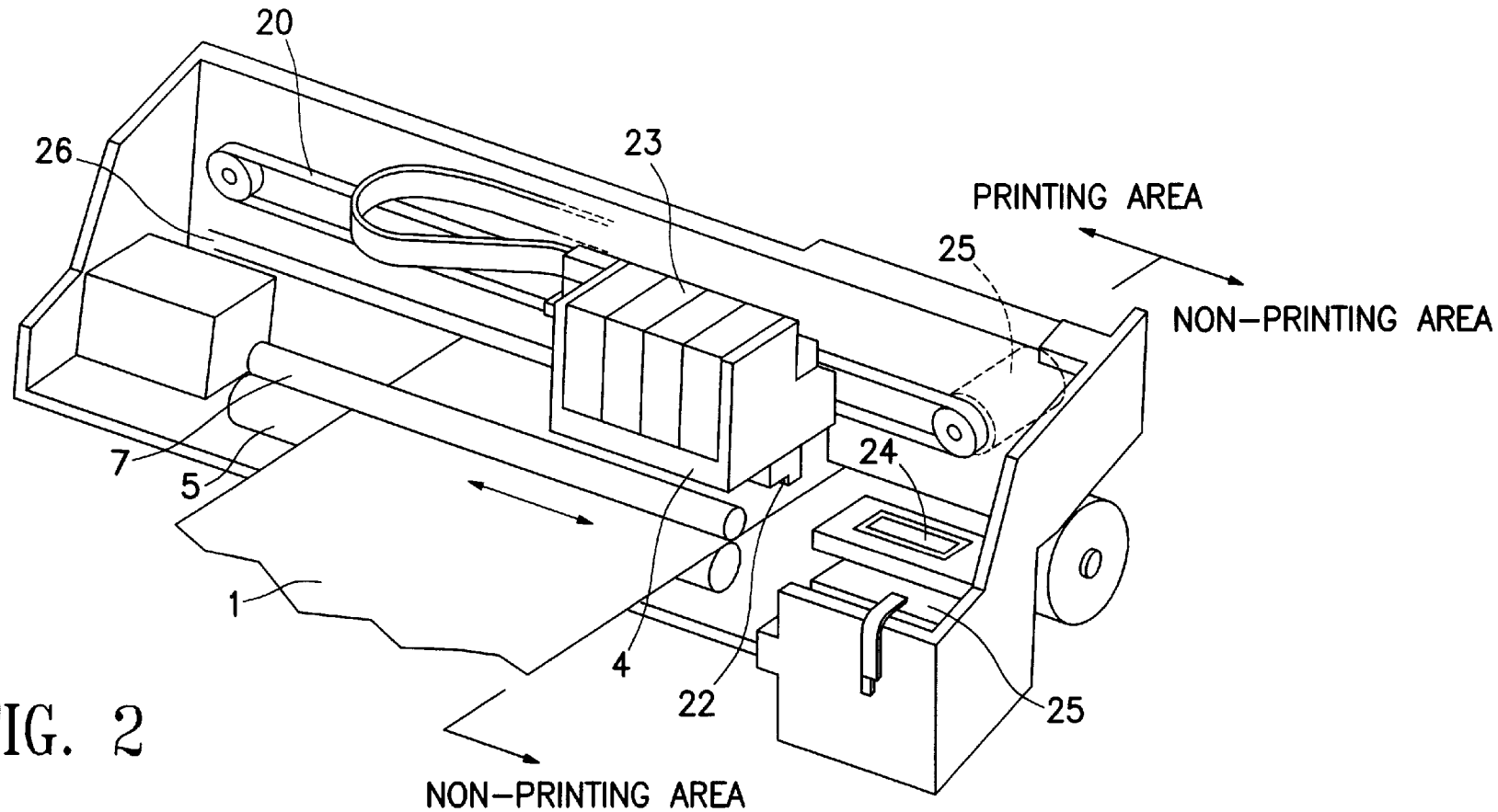
FIG. 2 is a perspective view of a printing mechanism of the FIG. 1 ink jet recording apparatus and component parts associated therewith.

Next, the arrangement of a printing mechanism of the ink jet recording apparatus 100 and component parts associated therewith will be described with reference to FIG. 2.

As shown in the figure, the carriage 4 is supported in a manner movable along a guide member 26. Further, the carriage 4 is connected to a carriage-driving motor 21 via a timing belt 20. As the carriage-driving motor 21 rotates, the carriage 4 moves in directions indicated by a two-headed arrow appearing in FIG. 2 (i.e. in directions perpendicular to a plane of the sheet of FIG. 1) in accordance with motion of the timing belt 20. This construction allows the carriage 4 to move in an area including a printing area located above the support/feed roller 5 in which printing on the tape 1 is carried out and a non-printing area extending rightward of the printing area as viewed in FIG. 2.

Arranged on a surface of the carriage 4 opposed to the tape 1 is the recording head (ink jet recording head) 22 including an array of nozzle openings for delivering ink therefrom. Further, the carriage 4 has an ink cartridge 23 mounted therein for supplying ink to the recording head 22. Printing is carried out by applying pressure to ink drops e.g. by piezo-electric elements or heating elements and thereby jetting them from the nozzle openings.

A capping device (capping member) 24 is arranged in the non-printing area located at the right end portion (as viewed in FIG. 2) of the area in which the carriage 4 is allowed to move.

Figure 3:
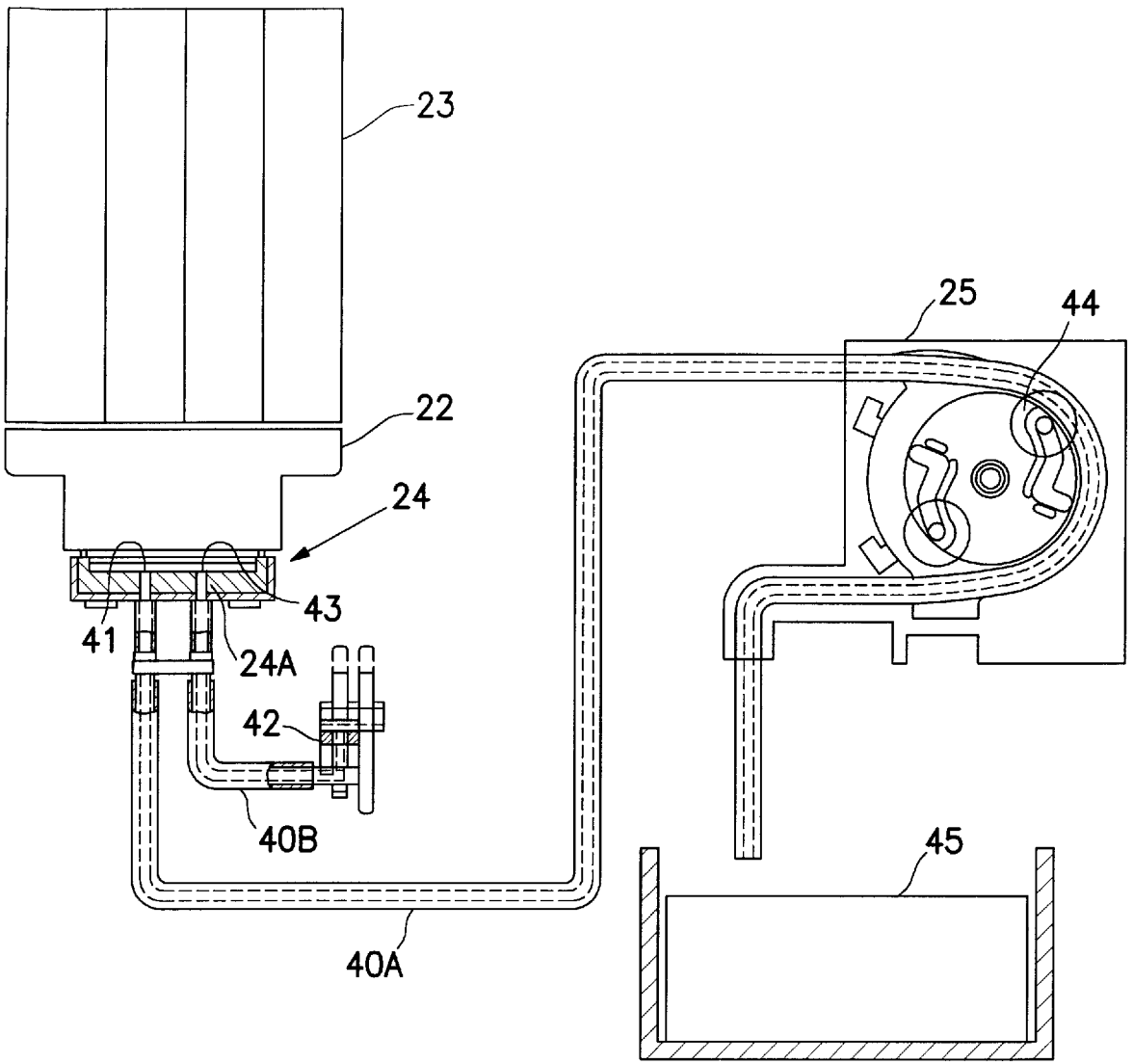
FIG. 3 is a schematic view showing the construction of a capping a device of the FIG. 1 ink jet recording apparatus and components associated therewith.

FIG. 3 schematically shows the arrangement of the capping device 24 and component parts associated therewith.

The capping device 24 includes a cap portion 24A for sealing the array of nozzle openings of the recording head 22 having the ink cartridge 23 connected thereto. The carriage 4 is moved to a position above the capping device 24 e.g. when the power is turned off, and the array of nozzle openings of the recording head 22 is sealed by the capping device 24, whereby the recording head 22 is hermetically capped.

During cleaning, the carriage 4 is also moved to the position above the capping device 24, and the array of nozzle openings of the recording head 22 is sealed by the capping device 24, whereby the recording head 22 is hermetically capped. In this case, when the array of nozzle openings of the recording head 22 is sealed, a pump (suction pump) 25 connected to the cap portion 24A via a tube 40A applies a negative pressure to the inside of the capping device 24 to thereby draw ink from the recording head 22 into the capping device 24 by suction.

On the other hand, when the array of nozzle openings of the recording head 22 is not sealed, i.e. when the nozzle openings are open, the pump 25 can draw in ink remaining within the capping device 24 by suction (this operation is referred to as "air suction") by applying negative pressure to the inside of the tube 40A.

The cap portion 24A is formed with an ink outlet port 41 connected to the pump 25 via the tube 40A for suction of ink by the pump 25 and an air inlet port 43 connected to a valve 42 via a tube 40B.

The valve 42 is controlled such that air is introduced little by little into a gap formed between the cap portion 24A and the recording head 22 when the nozzle openings hermetically sealed by the capping device 24 are made open.

The pump 25 continuously squeezes the flexible tube 40A by rotation of pulleys 44, to thereby suck ink and send the same to a waste-ink absorbent material 45. The amount of ink to be sucked by the pump 25 can be controlled easily since the rotation of the pulleys 44 and the amount of sucked ink are in a proportional relationship.

In the present embodiment, the pump 25 is a so-called tube pump, but another type of suction pump such as a piston pump or a bellows pump can also be used for the same purpose.

Figure 4:
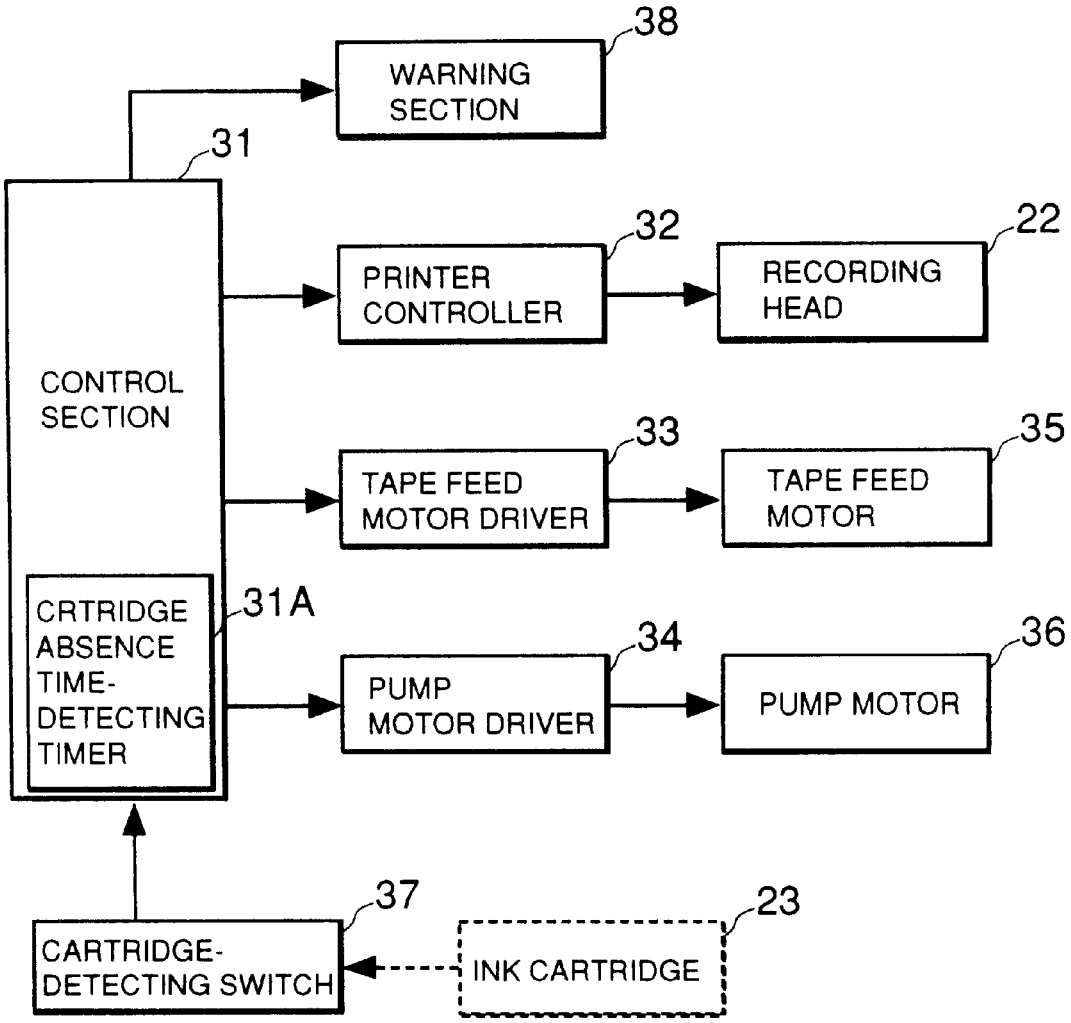
FIG. 4 is a block diagram showing the arrangement of a control system the FIG. 1 ink jet recording apparatus.

Next, a control system of the ink jet recording apparatus 100 will be described with reference to FIG. 4.

The control system is comprised of a control section 31 including a CPU and a ROM, not shown, and a cartridge absence time-measuring timer 31A for measuring a time period over which the ink jet recording apparatus 100 continues to be without an ink cartridge 23, a printer controller 32 for controlling operation of the recording head 22, a tape feed motor driver 33 for controlling a tape feed motor 35 to thereby control the amount of the tape 1 advanced by the tape feed motor 35, a pump motor driver 34 for driving a tube pump motor 36 for cleaning the recording head 22, a cartridge-detecting switch 37 for detecting whether or not an ink cartridge is mounted and delivering a cartridge-detecting signal SIC (which is at a high level when the ink cartridge is mounted in the ink jet recording apparatus 100), and a warning section 38 for performing warning operation under the control of the control section 31 when no ink cartridge is mounted in the apparatus 100. The control section 31 controls the recording head 22, the tape feed motor 35, and the pump motor 36 via the printer controller 32, the tape feed motor driver 33, and the pump motor driver 34, respectively, based on control programs stored in the ROM, and carries out processing for operations such as printing, cleaning, etc. Further the control section 31 controls the cleaning operation carried out when an ink cartridge is mounted in the apparatus 100 and the warning operation carried out when no ink cartridge is mounted, in response to the cartridge-detecting signal SIC from the cartridge-detecting switch 37.

Figure 5:
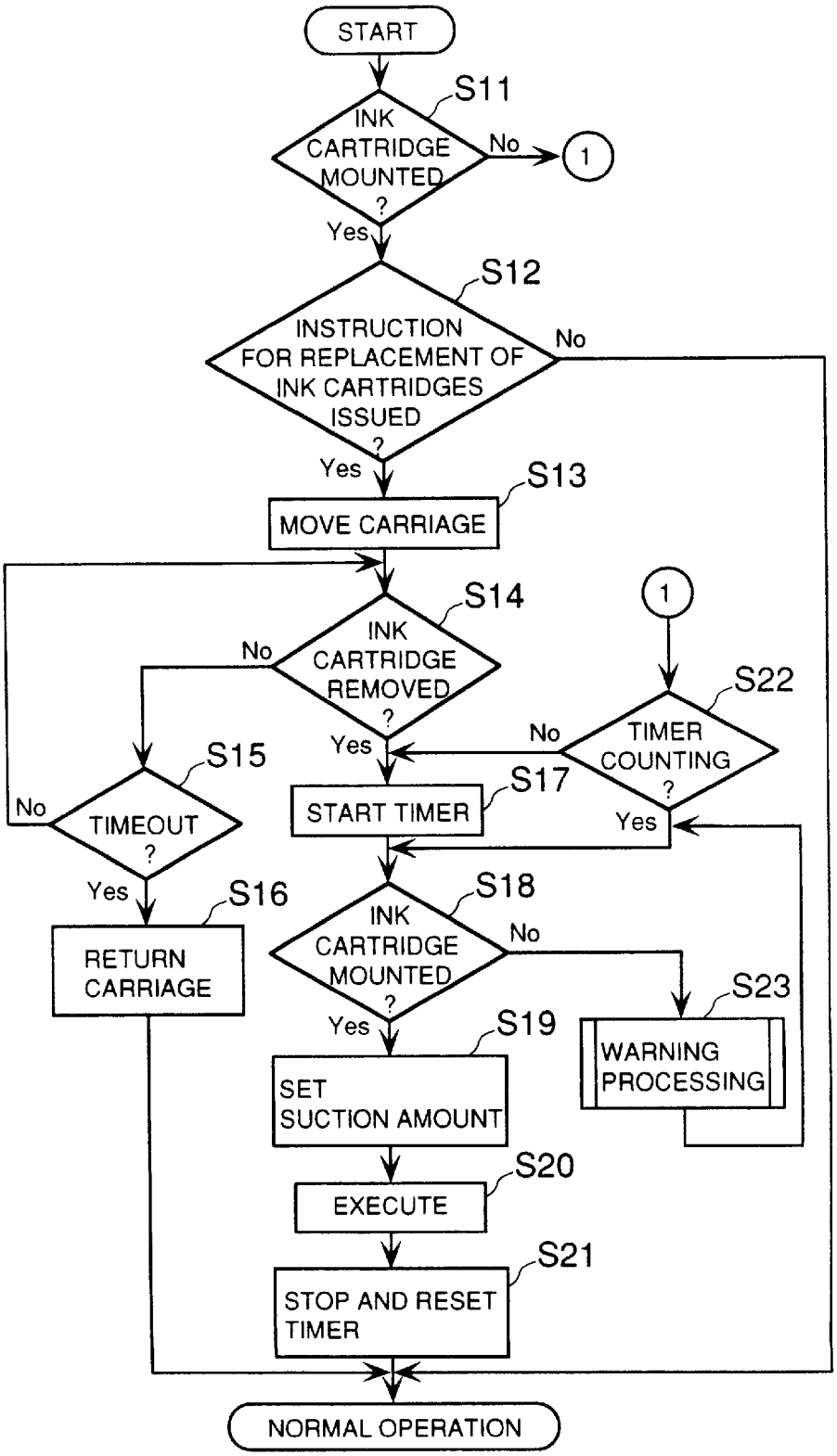
FIG. 5 is a flowchart showing a flow of operations performed by the FIG. 1 ink jet recording apparatus.

Next, the cleaning operation and the warning operation performed by the ink jet recording apparatus 100, dependent on detection of whether or not an ink cartridge is mounted will be described with reference to FIG. 5 showing a flow of operations for cleaning and warning.

First, when the power is turned on, the control section 31 determines at a step S11 whether or not an ink cartridge 23 is mounted in the ink jet recording apparatus 100, based on the cartridge-detecting signal SIC delivered from the cartridge-detecting switch 37.

If the ink cartridge 23 is mounted in the apparatus 100 (Yes to S11), it is determined at a step S12 whether or not there has been issued an instruction for replacement of ink cartridges in response to ink end detection occurring when the amount of ink remaining in the ink cartridge 23 becomes smaller than a predetermined reference amount or an instruction by the user for forced replacement of ink cartridges.

If neither of the instructions has been issued (No to S12), the program is terminated, followed by normal operation of the ink jet recording apparatus.

On the other hand, if either of the instructions has been issued (Yes to S12), the control section 31 causes the carriage 4 to be moved to a position for replacement of ink cartridges at a step S13, and determines at a step S14 whether or not the ink cartridge 23 has been removed from the carriage 4, based on the cartridge-detecting signal SIC.

If the ink cartridge 23 has not been removed from the carriage 4 (No to S14), it is determined at a step S15 whether or not a predetermined time period has elapsed since a time point when the either of the instructions for replacement of ink cartridges was issued, i.e. whether or not a timeout has occurred for replacement of ink cartridges.

If the timeout has not occurred (No to S15), the program returns to the step S14, wherein it is determined again whether or not the ink cartridge 23 has been removed from the carriage 4, based on the cartridge-detecting signal SIC.

If the timeout has occurred (Yes to S15), carriage return processing for returning the carriage 4 to its normal position is carried out at a step S16, followed by the normal operation.

If the ink cartridge 23 has been removed (Yes to S14), the control section 31 causes the cartridge absence time-measuring timer 31A to start at a step S17 so as to measure a cartridge absence time period, i.e. a time period during which the carriage 4 continues to be without the ink cartridge 23.

The cartridge absence time-measuring timer 31A has a backup power, not shown, connected thereto so as to allow the timer 31A to continue operating even after the power is turned off.

At the following step S18, the control section 31 determines whether or not a new ink cartridge 23 has been mounted in the apparatus 100.

If the ink cartridge 23 has not been mounted in the apparatus 100 yet (No to S18), the program proceeds to a step S23, wherein warning processing is executed.

In the warning processing, when the cartridge absence time period counted or measured by the timer 31A exceeds a predetermined time period, an alarm is issued so as to prompt the user to mount an ink cartridge, and then the program returns to the step S18.

More specifically, a buzzer, not shown, is driven to sound an alarm each time the cartridge absence time period exceeds one of predetermined time periods (e.g. 6 hours, 24 hours, 48 hours, and 168 hours) and whenever the power is turned on, so as to prompt the user to mount an ink cartridge, and a warning to the same effect is displayed by the use of a display block, not shown, such as a liquid crystal display or an LED indicator. Further, it is possible to give variety to the tone and sounding pattern of the buzzing sound, the flashing pattern of the LED indicator, and the message displayed by the display block, according to differences in the cartridge absence time period.

If the ink cartridge 23 has been mounted in the apparatus 100 (Yes to S18), the control section 31 sets the amount of ink to be sucked (hereinafter referred to as "the ink suction amount"), at a step S19.

Now, the relationship between the cartridge absence time period and the ink suction amount will be described with reference to FIG. 6. It should be noted that data corresponding to this relationship is stored in advance in the ROM or the RAM, not shown, in the form of a data table.

As shown in FIG. 6, when the cartridge absence time period t is equal to or longer than 0 hours and equal to or shorter than 6 hours ($0 \leqq t \leqq 6$), the replacement of ink cartridges is judged to be normal, and the control section 31 sets the ink suction amount to 0.3 (g) (which is equivalent to a value used in normal cleaning).

When the cartridge absence time period t is longer than 6 hours and equal to or shorter than 24 hours ($6 < t \leqq 24$), ink can have started solidifying, so that the ink suction amount is set to 0.5 (g) so as to suck more ink than in the normal cleaning.

Further, when the cartridge absence time period t is longer than 24 hours and equal to or shorter than 48 hours ($24 < t \leqq 48$), solidification of the ink can have proceeded, so that the ink suction amount is set to 1.0 (g) so as to suck still more ink.

When the cartridge absence time period t is longer than 48 hours and equal to or shorter than 168 hours=one week ($48 < t \leqq 168$), solidification of the ink can have further proceeded, so that the ink suction amount is set to 2.0 (g) so as to suck even more ink.

When the cartridge absence time period t is longer than 168 hours ($168 < t$), the ink can have considerably solidified, so that the ink suction amount is set to 3.0 (g) so as to suck a still larger amount of ink.

Subsequently, the control section 31 causes the pump motor driver 34 to drive the pump motor 36, whereby cleaning is carried out at a step S20.

At the following step S21, the control section 31 causes the cartridge absence time-measuring timer 31A to stop counting, and then resets the same, followed by the normal operation being started.

Thus, as the cartridge absence time period becomes longer, a larger amount of ink is sucked for cleaning, which ensures reliable cleaning. Further, since the user is not required to carry out the normal cleaning (the ink suction amount=0.3 (g)) repeatedly by manual operation until printing operation can be performed normally, it is possible to save the user's time and labor.

On the other hand, if the ink cartridge 23 is not mounted in the apparatus 100 (No to S11) when the power is turned on, it is determined at a step S22 whether or not the cartridge absence time-measuring timer 31A is counting or measuring the cartridge absence time period.

If the timer 31A is performing the counting or measuring (Yes to S22), the program proceeds to the step S18, wherein it is determined whether or not an ink cartridge has been mounted after it was removed. Then, dependent the result of the answer to this question, the program proceeds to the step S20 or S23, wherein the cleaning processing or the warning processing is carried out as described above.

If the timer 31A is not counting or measuring the cartridge absence time period at the step S22 (No to S22), it is judged that the ink cartridge 23 had been removed before the electric power was turned on, and the program proceeds to the step S17, wherein the timer 31A is started to count or measure the cartridge absence time period.

As described above, according to the present embodiment, as the cartridge absence time period becomes longer, a larger amount of ink is sucked for cleaning, so that reliable cleaning can be ensured. Further, the user is not required to carry out the normal cleaning in which the ink suction amount is set to a small value, repeatedly by manual operations until printing operation can be performed normally, which makes it possible to save the user's time and labor.

Moreover, according to the present embodiment, it is possible to issue a warning to the user whenever the cartridge absence time period exceeds one of predetermined time periods, so that the user can mount an ink cartridge immediately in response to the warning, which contributes to reduction of the cartridge absence time period.

As a result, the amount of ink used for cleaning after mounting of the ink cartridge in the ink jet recording apparatus can be decreased, whereby the amount of waste ink and cleaning cost can be reduced.

Although in the above embodiment, the present invention is applied to a label printer using a tape as the recording medium, this is not limitative, but the invention can also be applied to an ink jet recording apparatus of a type which is capable of carrying out printing e.g. on an A4-size cut sheet or a B5-size cut sheet.

Further, the invention can be applied to other types of ink jet recording apparatuses employing various recording methods already proposed, such as a method utilizing pressure control or thermal control.

It is further understood by those skilled in the art that the foregoing is a preferred embodiment of the invention, and that various changes and modifications may be made without departing from the spirit and scope thereof.

What is claimed is:

1. An ink jet recording apparatus for recording by using a replaceable ink cartridge mounted therein, comprising:

a recording head for delivering ink therefrom;

cleaning means for carrying out cleaning of said recording head by sucking ink therefrom;

cartridge absence time-detecting means for detecting a cartridge absence time period over which continues a cartridge-unmounted state of said ink jet recording apparatus in which said ink cartridge is removed from said ink jet recording apparatus; and suction amount-setting means for setting an amount of ink to be sucked for said cleaning, based on said cartridge absence time period, when said ink cartridge is mounted in said ink jet recording apparatus, said suction amount-setting means including storage means for storing predetermined values of said amount of ink to be sucked corresponding respectively to predetermined time periods to be detected as said cartridge absence time period.

2. An ink jet recording apparatus according to claim 1, further comprising cartridge-unmounted state-detecting means for detecting said cartridge-unmounted state of said ink jet recording apparatus.

3. An ink jet recording apparatus according to claim 2, wherein said cartridge absence time-detecting means includes timer means for counting duration of said cartridge-unmounted state of said ink jet recording apparatus detected by said cartridge-unmounted state-detecting means.

4. A method of controlling an ink jet recording apparatus for recording by using a replaceable ink cartridge mounted therein, said ink jet recording apparatus having a recording head connected to said ink cartridge for delivering ink supplied from said ink cartridge, the method comprising the steps of:

detecting a cartridge absence time period over which continues a cartridge-unmounted state of said ink jet recording apparatus in which said ink cartridge is removed from said ink jet recording apparatus; and setting an amount of ink to be sucked for cleaning of said recording head, based on said cartridge absence time period, when said ink cartridge is mounted in said ink jet recording apparatus, the step of setting an amount including the step of storing predetermined values of said amount of ink to be sucked corresponding respectively to predetermined time periods to be detected as said cartridge absence time period, and carrying out said cleaning of said recording head by sucking ink therefrom.

5. A method according to claim 4, wherein the step of detecting said cartridge absence time period includes the step of detecting whether or not said cartridge is mounted in said ink jet recording apparatus.

6. A method according to claim 5, wherein said ink jet recording apparatus includes timer means, and wherein the step of detecting said cartridge absence time period includes the steps of starting said timer means for counting duration of said cartridge-unmounted state of said ink jet recording apparatus when it is detected that said ink cartridge is not mounted in said ink jet recording apparatus, and the step of stopping said timer means for terminating the counting of said cartridge-unmounted state of said ink jet recording apparatus when it is detected that said ink cartridge is mounted in said ink jet recording apparatus.

* * * * *